US005360147A

United States Patent [19]

Aoki et al.

[11] Patent Number: 5,360,147

[45] Date of Patent: Nov. 1, 1994

[54] SLIDING NOZZLE FOR MOLTEN STEEL RECEIVING VESSEL

[75] Inventors: Takafumi Aoki; Masumi Ito, both of Gifu; Noriyoshi Naruse, Tokyo, all of Japan

[73] Assignees: Tokyo Yogyo Kabushiki Kaisha, Tokyo; Akechi Ceramics Co., Ltd., Gifu, both of Japan

[21] Appl. No.: 55,134

[22] Filed: Apr. 30, 1993

[30] Foreign Application Priority Data

Oct. 23, 1992 [JP] Japan ..... 4-309706

[51] Int. Cl.[5] ..... B22D 41/54

[52] U.S. Cl. ..... 222/600; 222/606; 266/236

[58] Field of Search ..... 266/236; 222/600, 606, 222/607, 590, 591, 597

[56] References Cited

U.S. PATENT DOCUMENTS

| | | | |
|---|---|---|---|
| 4,667,938 | 5/1987 | King | 222/600 |
| 4,792,070 | 12/1988 | Daussan et al. | 222/606 |
| 4,875,606 | 10/1989 | Keller | 222/600 |
| 5,052,598 | 10/1991 | King et al. | 222/600 |
| 5,062,553 | 11/1991 | King | 222/600 |
| 5,198,126 | 3/1993 | Lee | 222/606 |

FOREIGN PATENT DOCUMENTS

| | | |
|---|---|---|
| 0198237 | 10/1986 | European Pat. Off. . |
| 0382878 | 8/1990 | European Pat. Off. . |
| 2464769 | 3/1981 | France . |
| 1-59071 | 12/1989 | Japan . |
| 1602716 | 11/1981 | United Kingdom . |
| 1602717 | 11/1981 | United Kingdom . |
| 2153977A | 8/1985 | United Kingdom . |
| 2173725A | 10/1986 | United Kingdom . |
| 2249978A | 5/1992 | United Kingdom . |

*Primary Examiner*—Scott Kastler

*Attorney, Agent, or Firm*—Frishauf, Holtz, Goodman & Woodward

[57] ABSTRACT

A sliding nozzle for a molten steel receiving vessel, which comprises: an upper nozzle (22) made of a refractory inserted vertically into a bottom wall of a molten steel receiving vessel; a fixed plate (23) made of a refractory secured horizontally and stationarily to a lower end of the upper nozzle; a horizontally and reciprocally movable sliding plate (24) made of a refractory arranged below the fixed plate; a lower nozzle (25) made of a refractory secured vertically and stationarily below the sliding plate, the lower nozzle comprising a nozzle body (27) and a metallic frame (28) fitted to a flange (27A) at an upper end of the nozzle body, the lower nozzle having a length sufficient to cause a lower end portion thereof to be immersed into molten steel in a mold; a fitting device (30) for pressing the lower nozzle (25) against the lower end of the upper nozzle (22) through the sliding nozzle (24) and the fixed plate (23); and a driving unit (26) for causing the sliding plate (24) to slide horizontally and reciprocally between the fixed plate (23) and the lower nozzle (25).

4 Claims, 6 Drawing Sheets

SLIDING NOZZLE FOR MOLTEN STEEL RECEIVING VESSEL

As far as we know, there is available the following prior art document are considered to be pertinent to the present invention:

Japanese Patent Publication No. 1-59,071;published on Dec. 14, 1989

The contents of the above-mentioned prior art document will be discussed hereafter under the heading "BACKGROUND OF THE INVENTION."

BACKGROUND OF THE INVENTION

The present invention relates to a sliding nozzle which is secured to a bottom wall of a molten steel receiving vessel such as a ladle or a tundish.

In the prior art, continuous casting of molten steel is carried out in general as follows: Molten steel received in a tundish from a ladle is poured, through a sliding nozzle secured to a bottom wall of a tundish and an immersion nozzle secured vertically to a lower end of the sliding nozzle, into a mold arranged below the immersion nozzle to form a cast steel strand which is continuously withdrawn from the mold as a long cast strand.

The above-mentioned conventional sliding nozzle for a molten steel receiving vessel is disclosed in Japanese Patent Publication No. 1-59,071 published on Dec. 14, 1989 (hereinafter referred to as the "prior art"). The sliding nozzle A of the prior art for a molten steel receiving vessel is explained below with reference to a drawing.

FIG. 1 is a schematic vertical sectional view illustrating the sliding nozzle A of the prior art for a molten steel receiving vessel, which is secured to a bottom wall of a tundish.

As shown in FIG. 1, the sliding nozzle A of the prior art comprises an upper nozzle 1 made of a refractory, an upper fixed plate 2 made of a refractory, a sliding plate 3 made of a refractory, a lower fixed plate 4 made of a refractory, a driving means 5 for the sliding plate 3, and a lower nozzle 6 made of a refractory.

The upper nozzle 1 having a bore 1A is inserted vertically from below into an opening 9A in a nozzle receiving brick 9 provided on a bottom wall 8 of a tundish 7 as a molten steel receiving vessel.

The upper fixed plate 2 having a through-hole 2A and a horizontal lower surface is secured horizontally and stationarily to a lower end of the upper nozzle 1. The through-hole 2A of the upper fixed plate 2 is aligned with the bore 1A of the upper nozzle 1 relative to a common vertical axis.

The sliding plate 3 having a through-hole 3A and having a horizontal upper surface and a horizontal lower surface, is horizontally and reciprocally movable along the horizontal lower surface of the upper fixed plate 2 and a horizontal upper surface of the lower fixed plate 4 by means of the driving means 5 comprising a hydraulic cylinder or the like. The opening of the through-hole 2A of the upper fixed plate 2 is adjusted by causing the sliding plate 3 to slide horizontally, thereby controlling the flow rate of molten steel flowing out from the tundish 7.

The lower fixed plate 4 having a through-hole 4A and a horizontal upper surface is pressed by means of a second fitting means 16 described later through the upper fixed plate 2 and the sliding plate 3 against the lower end of the upper nozzle 1. The through-hole 4A of the lower fixed plate 4 is aligned with the bore 1A of the upper nozzle 1 relative to a common vertical axis.

The lower nozzle 6 having a bore 6A is secured vertically and stationarily to the lower surface of the lower fixed plate 3 by means of a first fitting means 11 described later. The bore 6A of the lower nozzle 6 is aligned with the bore 1A of the upper nozzle 1 relative to a common vertical axis. The lower nozzle 6 has a function of rectifying the flow of molten steel, the flow rate of which has been adjusted by the sliding of the sliding plate 3.

An immersion nozzle 10 having a through-hole 10A, to be connected to the above-mentioned sliding nozzle A, is vertically secured to the lower end of the lower nozzle 6 by means of the first fitting means 11. The through-hole 10A of the immersion nozzle 10 is aligned with the bore 1A of the upper nozzle 1 relative to a common vertical axis. A lower portion of the immersion nozzle 10 is immersed into molten steel poured in a mold (not shown).

The first fitting means 11 comprises a steel shell 12 covering the lower fixed plate plate 4 and the lower nozzle 6, a plurality of long bolts 13 fixed vertically to the steel shell 12 of the lower fixed plate 4, and a ring-shaped holder 14 fitted to a flange 10B of the immersion nozzle 10. According to the first fitting means 11, the immersion nozzle 10 is secured through the lower nozzle 6 vertically to the lower surface of the lower fixed plate 4, by fitting a nut 15 to each of the long bolts 13 running through the holder 14, and tightening the nut 15.

The second fitting means 16 comprises a metal fitting 17 fixed to the bottom wall 8 of the tundish 7, a plurality of arms 19, each being loosely attached to a lower surface of the metalfitting 17 by means of a bolt 18, and a plurality of pins 21, each of which is provided in the metal fitting 17 and is vertically pushed down by means of a spring 20. According to the above-mentioned second fitting means 16, the lower fixed plate 4 is pressed, together with the lower nozzle 6 and the immersion nozzle 10, against the lower end of the upper nozzle 1 through the sliding plate 3 and the upper fixed plate 2, by pushing down one end of each arm 19 by means of the pin 21 under the action of an elastic force of the spring 20 so as to push up the other end of the arm 19 with the bolt 18 as a fulcrum, thus pressing up the lower surface of the lower fixed plate 4.

According to the above-mentioned sliding nozzle A of the prior art, it is possible to control the flow rate of molten steel which is poured from the tundish 7 through the upper nozzle 1, the sliding nozzle A, the lower nozzle 6 and the immersion nozzle 10 into the mold (not shown), by causing the sliding plate 3, by the actuation of the driving means 5, to slide horizontally along the horizontal lower surface of the upper fixed plate 2 and the horizontal upper surface of the lower fixed plate 3, thereby adjusting the respective openings of the through-hole 2A of the upper fixed plate 2 and the through-hole 4A of the lower fixed plate 4.

However, the above-mentioned sliding nozzle A of the prior art has the following problems:

(1) In order to secure the sliding nozzle A to the tundish 7, it is necessary first to secure the immersion nozzle 10 through the lower nozzle 6 vertically to the lower surface of the lower fixed plate 4 by means of the first fitting means 11, and then to press the lower fixed plate 4, together with the lower nozzle 6 and the immersion nozzle 10, against the lower end of the upper nozzle 1 through the sliding plate 3 and the upper fixed plate 2 by means of the second fitting means 16. Securing of the sliding nozzle A to the tundish 7 is therefore intricate and time-consuming.

(2) Mortar, which is applied onto the junctions between the lower fixed plate 4 and the lower nozzle 6 and between the lower nozzle 6 and the immersion nozzle 10, contracts under the effect of heat received from molten steel, and becomes brittle. As a result, gaps are produced in the above-mentioned junctions, thus leading to a lower tightness against molten steel at the abovementioned junctions.

(3) Thermal expansion of the long bolts 13 and the ring-shaped holder 14 of the first fitting means 11 results in a lower securing function of the first fitting means 11, thus leading to a lower tightness against molten steel at the above-mentioned junctions.

(4) The arms 19 of the second fitting means 16, which locally press the lower surface of the lower fixed plate 4, tend to cause breakage of the lower fixed plate 4.

Under such circumstances, there is a strong demand for the development of a sliding nozzle for a molten steel receiving vessel, which permits an easy securing to a tundish, has an excellent tightness against molten steel, and is free from breakage of a lower fixed plate, which breakage tends to occur under the effect of a fitting means locally pressing the lower fixed plate, but such a sliding nozzle has not as yet been proposed.

SUMMARY OF THE INVENTION

An object of the present invention is therefore to provide a sliding nozzle for a molten steel receiving vessel, which permits an easy securing to a tundish, has an excellent tightness against molten steel, and is free from breakage of a lower fixed plate, which breakage tends to occur under the effect of a fitting means locally pressing the lower fixed plate.

In accordance with one of the features of the present invention, there is provided a sliding nozzle for a molten steel receiving vessel, which comprises:

an upper nozzle made of a refractory, having a bore and inserted vertically from below into an opening in a nozzle receiving brick provided on a bottom wall of a molten steel receiving vessel;

a fixed plate made of a refractory, having a through-hole and a horizontal lower surface, and secured horizontally and stationarily to a lower end of said upper nozzle, said through-hole of said fixed plate being aligned with said bore of said upper nozzle relative to a common vertical axis;

a horizontally and reciprocally movable sliding plate made of a refractory, having a through-hole and having a horizontal upper surface and a horizontal lower surface, said horizontal upper surface of said sliding plate being slidable along said horizontal lower surface of said fixed plate;

a lower nozzle made of a refractory, having a bore and a horizontal upper surface, and secured vertically and stationarily below said sliding plate, said lower nozzle comprising a nozzle body and a metallic frame fitted to a flange at an upper end of said nozzle body, said lower nozzle having a length sufficient to cause a lower portion thereof to be immersed into molten steel in a mold arranged below said lower nozzle, said bore of said lower nozzle being aligned with said bore of said upper nozzle relative to a common vertical axis, and said horizontal lower surface of said sliding plate being slidable along said horizontal upper surface of said lower nozzle;

a fitting means for pressing said lower nozzle against said lower end of said upper nozzle through said sliding plate and said fixed plate; and a driving means for causing said sliding plate to slide horizontally and reciprocally along said horizontal lower surface of said fixed plate and said horizontal upper surface of said lower nozzle.

DETAILED DESCRIPTION OF PREFERRED EMBODIMENTS

From the above-mentioned point of view, extensive studies were carried out to develop a sliding nozzle for a molten steel receiving vessel, which permits an easy securing to a tundish, has an excellent tightness against molten steel, and is free from breakage of a lower fixed plate, which breakage tends to occur under the effect of a fitting means locally pressing the lower fixed plate.

As a result, the following findings were obtained: By forming a lower fixed plate, a lower nozzle and an immersion nozzle integrally into a long lower nozzle, and fitting a metallic frame to a flange at an upper end of the thus formed long lower nozzle, it is possible to obtain a sliding nozzle for a molten steel receiving vessel, which permits an easy securing to a tundish, has an excellent tightness against molten steel, and is free from breakage of a lower fixed plate, which breakage tends to occur under the effect of a fitting means locally pressing the lower fixed plate.

The present invention was made on the basis of the above-mentioned findings. Now, an embodiment of the sliding nozzle B of the present invention for a molten steel receiving vessel, is described with reference to the drawings.

Figure 2:
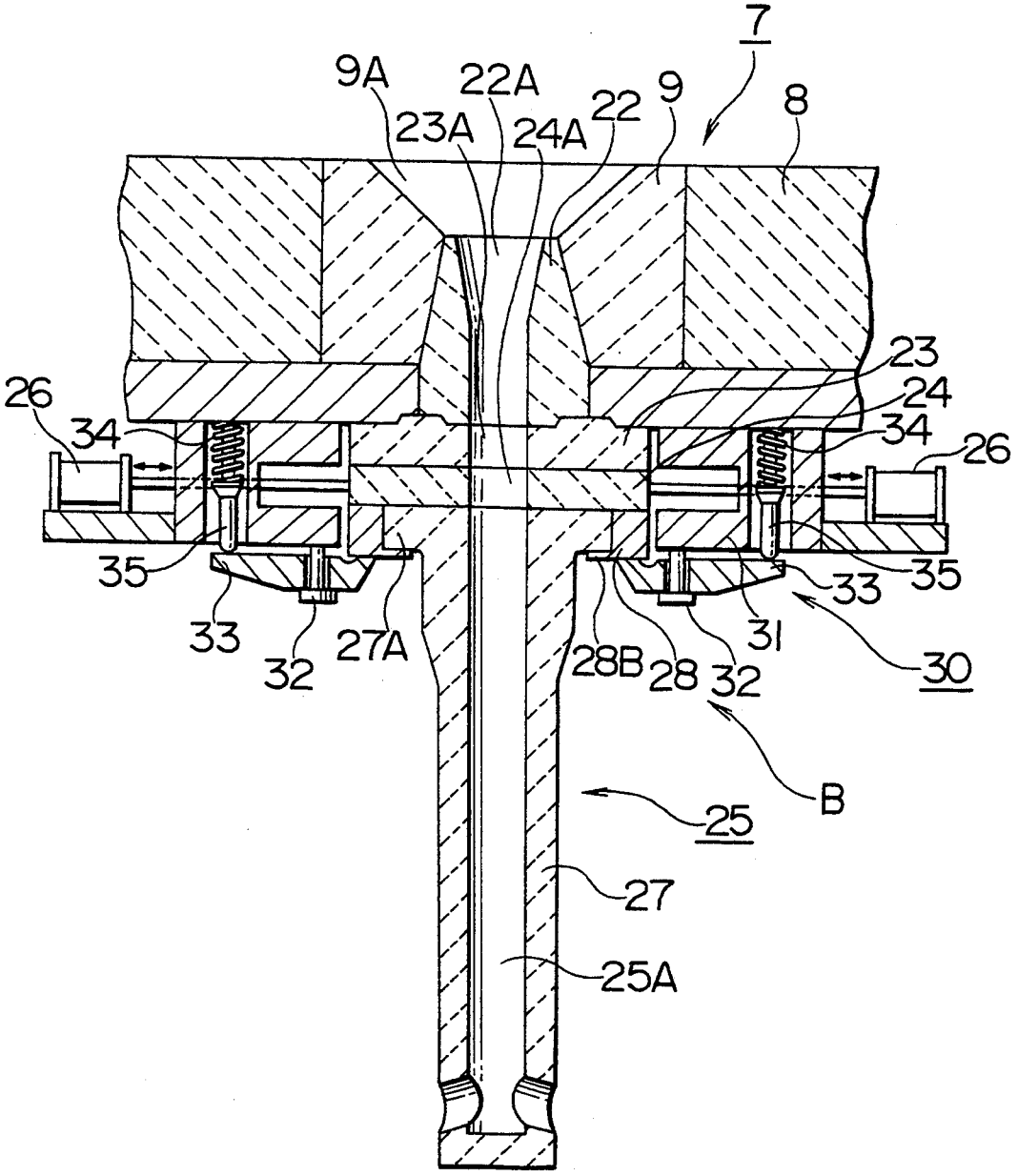
FIG. 2 is a schematic vertical sectional view illustrating an embodiment of the sliding nozzle of the present invention for a molten steel receiving vessel, which is secured to a bottom wall of a tundish.
Figure 3:
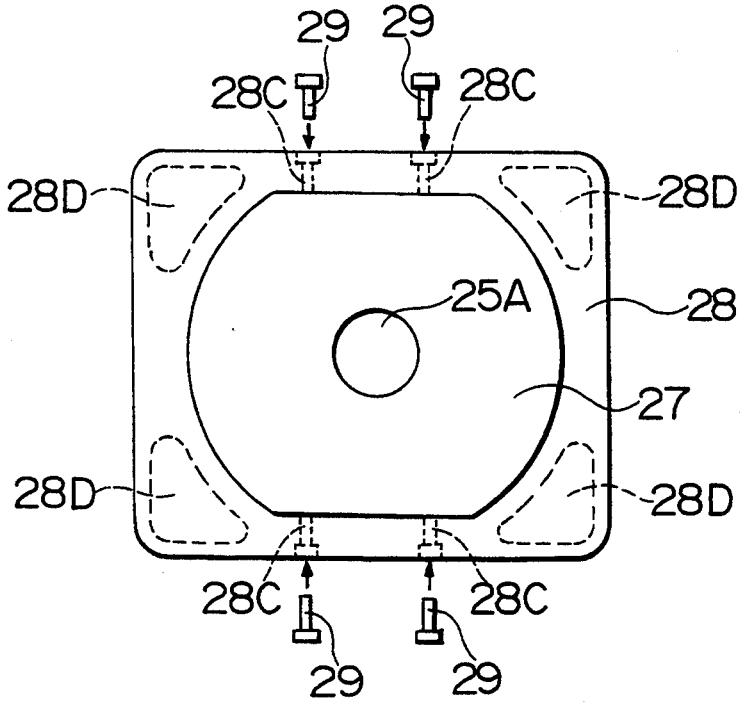
FIG. 3 is a plan view illustrating a lower nozzle of the sliding nozzle of the present invention for a molten steel receiving vessel.
Figure 4:
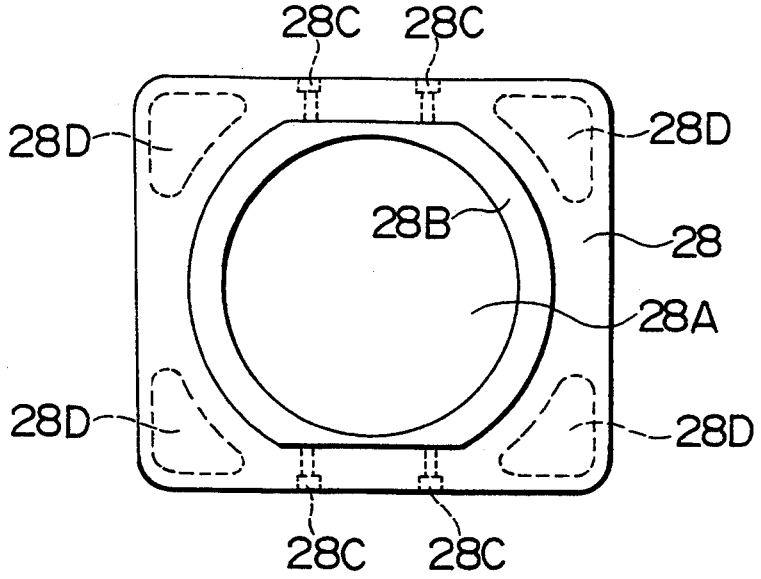
FIG. 4 is a plan view illustrating a metallic frame of the lower nozzle of the sliding nozzle of the present invention for a molten steel receiving vessel.

FIG. 2 is a schematic vertical sectional view illustrating an embodiment of the sliding nozzle of the present invention for a molten steel receiving vessel, which is secured to a bottom wall of a tundish; FIG. 3 is a plan view illustrating a lower nozzle of the sliding nozzle of the present invention for a molten steel receiving vessel; and FIG. 4 is a plan view illustrating a metallic frame of the lower nozzle of the sliding nozzle of the present invention for a molten steel receiving vessel.

As shown in FIG. 2, the sliding nozzle B of the present invention for a molten steel receiving vessel comprises an upper nozzle 22 made of a refractory, a fixed plate 23 made of a refractory, a sliding plate 24 made of a refractory, a lower nozzle 25 made of a refractory, and a driving means 26 for the sliding plate 24.

The upper nozzle 22 having a bore 22A is inserted vertically from below into an opening 9A in a nozzle receiving brick 9 provided on a bottom wall 8 of a tundish 7 as a molten steel receiving vessel.

The fixed plate 23 having a through-hole 23A and a horizontal lower surface is secured horizontally and stationarily to a lower end of the upper nozzle 22. The through-hole 23A of the fixed plate 23 is aligned with the bore 22A of the upper nozzle 22 relative to a common vertical axis.

The sliding plate 24 having a through-hole 24A and having a horizontal upper surface and a horizontal lower surface, is horizontally and reciprocally slidable along the horizontal lower surface of the fixed plate 23 and a horizontal upper surface of the lower nozzle 25 by means of the driving means 26 comprising a hydraulic cylinder or the like. The opening of the through-hole 23A of the fixed plate 23 is adjusted by causing the sliding plate 24 to slide horizontally, thereby controlling the flow rate of molten steel flowing out from the tundish 7.

The lower nozzle 25 having a bore 25A and a horizontal upper surface is secured vertically and stationarily below the sliding plate 24 by means of a fitting means 30 described later. The lower nozzle 25 comprises a nozzle body 27 and a metallic frame 28 fitted to a flange 27A at an upper end of the nozzle body 27. The lower nozzle 25 has a length sufficient to cause a lower portion thereof to be immersed into molten steel in a mold (not shown) arranged below the lower nozzle 25. The bore 25A of the lower nozzle 25 is aligned with the bore 22A of the upper nozzle 22 relative to a common vertical axis. The horizontal lower surface of the sliding plate 24 slides along the horizontal upper surface of the lower nozzle 25. The lower nozzle 25 comprises an $A1_2O_3$-$SiO_2$-C refractory excellent in erosion resistance against molten steel.

An opening 28A for inserting the nozzle body 27 of the lower nozzle 25 is formed, as shown in FIG. 4, at a center portion of the metallic frame 28 of the lower nozzle 25, and a flange 28B on which the flange 27A of the nozzle body 27 is to be mounted, is formed on the periphery of the opening 28A of the metallic frame 28. A plurality of bolt holes 28C for fixing bolts 29 for fixing the nozzle body 27 of the lower nozzle 25, are formed on each of the both sides of the metallic frame 28. A cavity 28D for reducing the weight of the metallic frame 28 is provided in each of the four corners of the metallic frame 28. When fixing the metallic frame 28 to the nozzle body 27 of the lower nozzle 25, the nozzle body 27 is inserted into the opening 28A of the metallic frame 28 and the fixing bolt 29 is driven into each of the bolt holes 28C of the metallic frame 28, as shown in FIG. 3.

A fitting means 30 is constructed in the same manner as in the second fitting means 16 of the prior art as described above. More specifically, the fitting means 30 comprises a metal fitting 31 fixed to the bottom wall 8 of the tundish 7, a plurality of arms 33, each being loosely attached to a lower surface of the metal fitting 31 by means of a bolt 32, and a plurality of pins 35, each of which is provided in the metal fitting 31 and is vertically pushed down by means of a spring 34. According to the above-mentioned fitting means 30, the lower nozzle 25 is pressed against the lower end of the upper nozzle 22 through the sliding nozzle 24 and the fixed plate 23, by pushing down one end of each arm 33 by means of the pin 35 under the action of an elastic force of the spring 34 so as to push up the other end of the arm 33 with the bolt 32 as a fulcrum, thus pressing up the lower surface of the metallic frame 28 of the lower nozzle 25. Since the pressing force applied by means of the plurality of arms 33 of the fitting means 30 acts through the flange 28B of the metallic frame 28 onto the flange 27A of the lower nozzle 25, it is possible to prevent damage to the lower nozzle 25.

According to the above-mentioned sliding nozzle B of the present invention, it is possible to control the flow rate of molten steel which is poured from the tundish through the upper nozzle 22, the sliding nozzle B and the lower nozzle 25 into the mold (not shown), by actuating the driving means 26 to cause the sliding plate 24 to slide horizontally along the horizontal lower surface of the fixed plate 23 and the horizontal upper surface of the lower nozzle 25, thereby adjusting the respective openings of the through-hole 23A of the fixed plate 23 and the bore 25A of the lower nozzle 25.

In the sliding nozzle B of the present invention, the single lower nozzle 25 having the functions of the upper fixed plate 2 and the lower nozzle 6 in the sliding nozzle A of the prior art as well as the functions of the immersion nozzle 10 to be connected to the sliding nozzle A, is secured vertically and stationarily below the sliding plate 24 by means of only the fitting means 30. It is therefore possible to easily secure the sliding nozzle B to the bottom wall 8 of the tundish 7. In addition, since the lower nozzle 25 is constructed as an integral assembly, an excellent tightness against molten steel is available, and since the pressing force applied by means of the plurality of arm 33 of the fitting means 30 does not act locally onto the flange 27A of the lower nozzle 25, it is possible to prevent damage to the lower nozzle 25.

Figure 5:
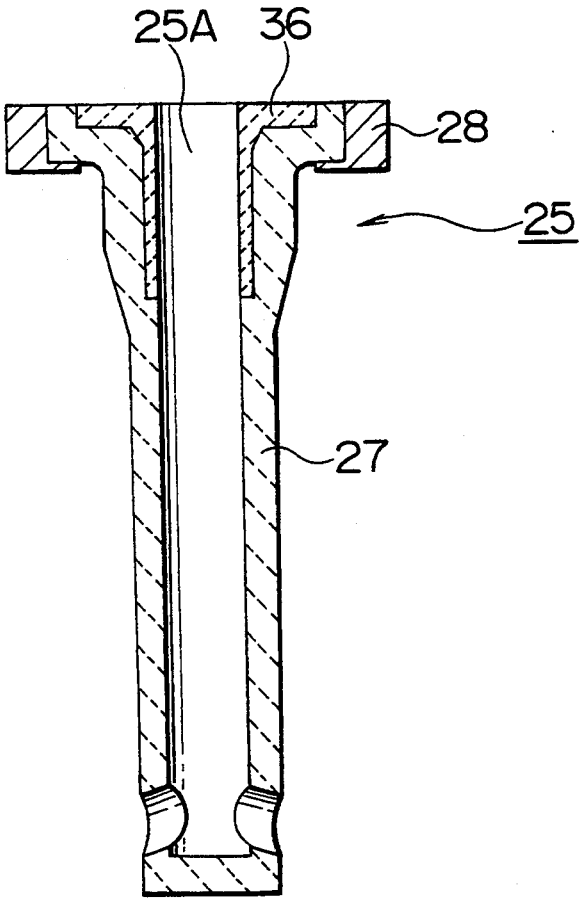
FIG. 5 is a vertical sectional view illustrating another lower nozzle of the sliding nozzle of the present invention for a molten steel receiving vessel.

FIG. 5 is a vertical sectional view illustrating another lower nozzle of the sliding nozzle of the present invention for a molten steel receiving vessel.

A local erosion of the bore 25A of the lower nozzle 25 caused by a deflected flow of molten steel, can certainly be prevented by forming, as shown in FIG. 5, an upper portion of the bore 25A of the lower nozzle 25 with a refractory layer 36 comprising any one of an $Al_2O_3$-$SiO_2$ refractory and an $Al_2O_3$-$SiO_2$-C refractory having a carbon (C) content of up to 10 wt. %.

Figure 6:
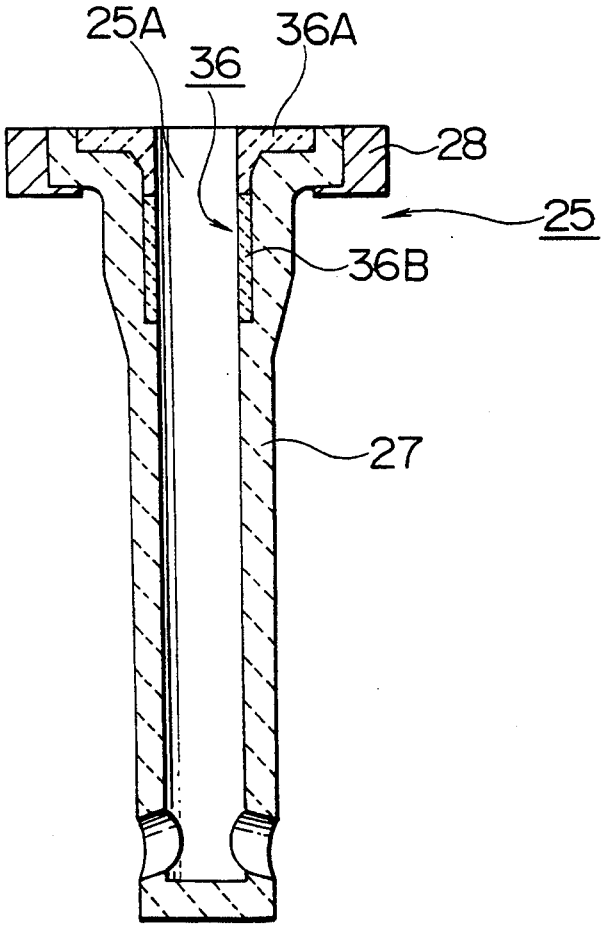
FIG. 6 is a vertical sectional view illustrating further another lower nozzle of the sliding nozzle of the present invention for a molten steel receiving vessel.

FIG. 6 is a vertical sectional view illustrating another lower nozzle of the sliding nozzle of the present invention for molten steel receiving vessel.

It is possible to prevent a local erosion of the bore 25A of the lower nozzle 25 caused by a deflected flow of molten steel and to ensure smooth sliding between the horizontal upper surface of the lower nozzle 25 and the horizontal lower surface of the sliding plate 24, by forming, as shown in FIG. 6, the above-mentioned refractory layer 36 into two portions, i.e., an upper portion 36A comprising a high-$Al_2O_3$ refractory having a carbon (C) content of up to 10 wt. %, which hardly permits the occurrence of cracks and surface toughening, on the one hand, and a lower portion 36B comprising any one of an $Al_2O_3$-$SiO_2$ refractory and an $Al_2O_3$-$SiO_2$-C refractory having a carbon (C) content of up to 10 wt. %, which are excellent in erosion resistance against molten steel having a deflected flow, on the other hand.

Figure 7:
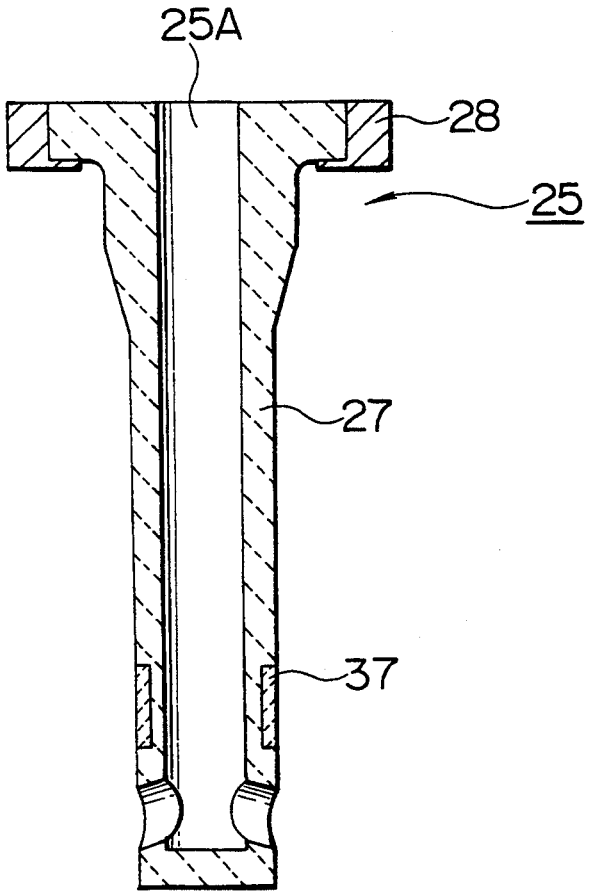
FIG. 7 is a vertical sectional view illustrating further still another lower nozzle of the sliding nozzle of the present invention for a molten steel receiving vessel.

FIG. 7 is a vertical sectional view illustrating still another lower nozzle of the sliding nozzle of the present invention for a molten steel receiving vessel.

It is possible to further extend the service life of the lower nozzle 25, by forming, as shown in FIG. 7, an outer portion of the lower nozzle 25, which outer portion is in contact with molten mold powder on the surface of molten steel in the mold (not shown), with another refractory layer 37 comprising a $ZrO_2$-C refractory, which is excellent in erosion resistance against molten mold powder.

Now, the sliding nozzle of the present invention is described further in detail by means of an example.

EXAMPLE

A cast steel strand of aluminum-killed steel was cast by the use of the sliding nozzle B of the present invention as shown in FIG. 2. In the sliding nozzle B, the lower nozzle 25 as shown in FIG. 5 was used, in which an upper portion of the bore 25A of the lower nozzle 25 was formed of a refractory layer 36 excellent in erosion resistance against molten steel having a deflected flow. A cast steel strand was cast for each of the two kinds of lower nozzle 25 having respective refractory layers 36 of different materials. The casting conditions are shown in Table 1, and the chemical compositions and the physical properties of the lower nozzles 25 and the refractory layers 36 are shown in Table 2.

TABLE 1

| | |
|---|---|
| Ladle capacity | 250 tons |
| Casting time | 50 minutes/charge |
| Withdrawing time | 1.2 m/minute |
| Cast strand size | 230 × 1,500 mm |

TABLE 2

| | Refractory layer | | Lower |
|---|---|---|---|
| | (1) | (2) | nozzle |
| Chemical composition (wt. %) | | | |
| C | — | 6.0 | 25.4 |
| $Al_2O_3$ | 85.5 | 80.8 | 54.1 |
| $SiO_2$ | 12.8 | 13.0 | 20.3 |
| Physical properties | | | |
| Porosity (%) | 16.7 | 8.0 | 14.2 |
| Bulk density (g/cc) | 2.83 | 2.90 | 2.35 |
| Compressive strength ($Kg/cm^2$) | 1,400 | 1,000 | 460 |

Figure 1:
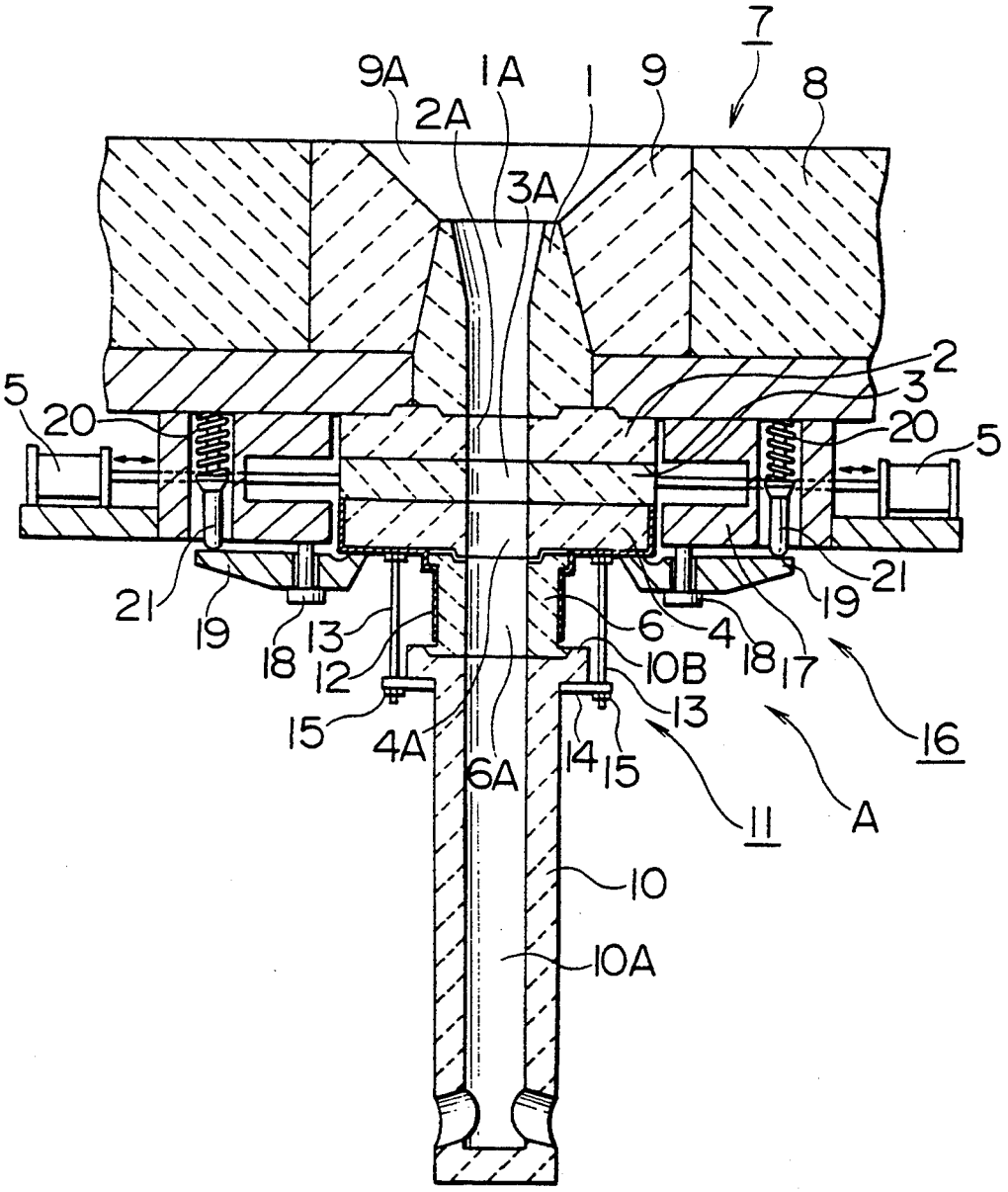
FIG. 1 PRIOR ART
FIG. 1 is a schematic vertical sectional view illustrating a sliding nozzle A of the prior art for a molten steel receiving vessel, which is secured to a bottom wall of a tundish.

Then, a cast steel strand of aluminum-killed steel was cast by the use of the conventional sliding nozzle A as shown in FIG. 1 under the same casting conditions as those shown in Table 1. The lower fixed plate 4 and the lower nozzle 6 of the sliding nozzle A used in this casting each comprised the same refractory as in the refractory layer (1) shown in Table 2, and the immersion nozzle 10 comprised the same refractory as in the lower nozzle shown in Table 2.

As a result, the conventional sliding nozzle A permitted casting of only three charges. This was attributable to the turbulence of molten steel in the mold caused by the entanglement of air from the junctions between the lower fixed plate 4 and the lower nozzle 6 and between the lower nozzle 6 and the immersion nozzle 10 in the sliding nozzle A, the resultant lower steel quality, and the leakage of molten steel caused by the local erosion of the junction between the lower nozzle 6 and the immersion nozzle 10.

In contrast, the sliding nozzle B of the present invention having the lower nozzle 25, in which the upper portion of the bore 25A of the lower nozzle 25 was formed of the refractory layer (1) shown in Table 2, permitted casting of six charges. The sliding nozzle B of the present invention having the lower nozzle 25, in which the upper portion of the bore 25A of the lower nozzle 25 was formed of the refractory layer (2) shown in Table 2, permitted casting of eight charges. The increase in the casting frequency as compared with that in the conventional sliding nozzle A was due to the fact that, because the lower nozzle 25 of the sliding nozzle B was constructed as an integral assembly, there occurred no turbulence of molten steel in the mold caused by the entanglement of air, decrease in steel quality resulting therefrom, and the leakage of molten steel caused by local erosion of the junction.

According to the present invention, as described above, it is possible to obtain a sliding nozzle for a molten steel receiving vessel, which permits an easy securing to a tundish, has an excellent tightness against molten steel, and is free from breakage of a lower fixed plate, which breakage tends to occur under the effect of a fitting means locally pressing the lower fixed plate, thus providing many industrially useful effects.

What is claimed is:

1. A sliding nozzle for a molten steel receiving vessel, which comprises:

an upper nozzle (22) made of a refractory, said upper nozzle (22) having a bore (22A) therein and said upper nozzle (22) being inserted vertically from below into an opening (9*a*) in a nozzle receiving brick (9) provided on a bottom wall (8) of a molten steel receiving vessel (7);

a fixed plate (23) made of a refractory, said fixed plate (23) having a through-hole (23A) and a horizontal lower surface, and said fixed plate (23) being secured horizontally and stationarily to a lower end of said upper nozzle (22), said through-hole (23A) of said fixed plate (23) being aligned with said bore (22A) of said upper nozzle (22) relative to a common vertical axis;

a horizontally and reciprocally movable sliding plate (24) made of a refractory, said sliding plate (24) having a through-hole (24A) and having a horizontal upper surface and a horizontal lower surface, said horizontal upper surface of said sliding plate (24) being slidable along said horizontal lower surface of said fixed plate (23);

a lower nozzle (25) made of a refractory, said lower nozzle (25) having a bore (25A) and a horizontal upper surface, and said lower nozzle (25) being secured vertically and stationarily below said sliding plate (24), said lower nozzle (25) comprising a nozzle body (27) and a metallic frame (28) fitted to a flange (27A) at an upper end of said nozzle body (27), an upper portion of said bore (25A) of said lower nozzle (25) comprising an upper bore portion (36A) and a lower bore portion (36B), said upper bore portion (36A) comprising a high-$Al_2O_3$ refractory having a carbon (C) content of up to 10 wt. %, and said lower bore portion (36B) comprising any one of an $Al_2O_3$-$SiO_2$ refractory and an $Al_2O_3$-$SiO_2$-C refractory and an $Al_2O_3$-$SiO_2$-C refractory having a carbon (C) content of up to 10 wt. %, said lower nozzle (25) having a length sufficient to cause a lower portion thereof to be immersed into molten steel in a mold arranged below said lower nozzle (25), said bore (25A) of said lower nozzle (25) being aligned with said bore (22A) of said upper nozzle (22) relative to a common vertical axis, and said horizontal lower surface of said sliding plate (24) being slidable along said horizontal upper surface of said lower nozzle (25);

fitting means (30) for pressing said lower nozzle (25) against said lower end of said upper nozzle (22) through said sliding plate (24) and said fixed plate (23); and driving means (26) for causing said sliding plate (24) to slide horizontally and reciprocally along said horizontal lower surface of said fixed plate (23) and along said horizontal upper surface of said lower nozzle (25).

2. A sliding nozzle as claimed in claim 1, wherein an outer portion of said lower nozzle (25), which outer portion is in contact with molten mold powder on the surface of molten steel in said mold, has another refractory layer (37) excellent in erosion resistance against molten mold powder.

3. A sliding nozzle as claimed in claim 2, wherein: said another refractory layer (37) comprises a $ZrO_2$-C refractory.

4. A sliding nozzle as claimed in claim 1, wherein said fitting means (30) comprises:

a metal fitting (31) fixable to a bottom wall (8) of a molten steel receiving vessel (7);

a plurality of arms (33), each arm being loosely attached to a lower surface of said metal fitting (31) by means of a bolt (32); and a plurality of pins (35), each of which is provided in said metal fitting (31) and is vertically pushed down by means of a spring (34), each of said plurality of pins (35) pushing down one end of a respective arm (33) by means of said pin (35) under the action of an elastic force of said spring (34) so as to push up the other end of said receptive arm (33) with said bolt (32) as a fulcrum, thus pressing up a lower surface of said metallic frame (28) of said lower nozzle (25), whereby said lower nozzle (25) is pressed against said lower end of said upper nozzle (22) through said sliding nozzle (24) and said fixed plate (23).

* * * * *